United States Patent [19]

Penn

[11] Patent Number: 4,754,125

[45] Date of Patent: Jun. 28, 1988

[54] TIME-TAPE CALCULATOR

[76] Inventor: Roy A. Penn, 406 N. Citrus Ave., Los Angeles, Calif. 90036

[21] Appl. No.: 935,811

[22] Filed: Nov. 28, 1986

[51] Int. Cl.[4] ..... G06C 3/00

[52] U.S. Cl. ..... 235/88 R; 235/78 R

[58] Field of Search ..... 235/103, 78 R, 88 R, 235/119

[56] References Cited

U.S. PATENT DOCUMENTS

| | | | |
|---|---|---|---|
| 3,157,354 | 11/1964 | Henry | 235/119 |
| 3,747,846 | 7/1973 | Long | 235/78 X |
| 4,456,821 | 6/1984 | Harten | 235/78 R |

*Primary Examiner*—Benjamin R. Fuller

*Attorney, Agent, or Firm*—Ciotti & Murashige, Irella & Manella

[57] ABSTRACT

Apparatus for use in correlating actual tape play times, tape length, or predetermined tape program locations with tape-spool revolution values provided by a tape-revolution index counter in a tape machine. The calculator has a lower circular base plate and a smaller, upper circular plate which rotates concentrically with respect to the lower plate. The base plate carries a scale corresponding to tape-spool revolution values indicated by the machine, and one or more time scales relating tape spool revolution values to actual tape-play times, and/or to remaining play times or program locations. A ratio marker and time scale indicator are positioned on the upper member such that alignment of the ratio marker with a selected tape-revolution value on the base plate brings the time scale indicator into alignment with the corresponding playing-time value on the base plate.

7 Claims, 1 Drawing Sheet

TIME-TAPE CALCULATOR

1. FIELD OF THE INVENTION

The present invention relates to a mechanical calculator device for use in correlating actual tape-play time to index counter readings in a tape recording/playing machine.

2. BACKGROUND

Video cassette recorders (VCRs) currently enjoy a wide popularity for recording and playing movies and other subject matter. The most common type of videocassette is a VHS format cassette commonly referred to as the "T-120", having approximately 246 meters of tape and allowing up to about 2, 4, or 6 hours of recording time, depending on the selected machine recording speed. It is often desirable, in playing or recording material on a VCR, to have a fairly accurate estimate of where on a tape a certain program is contained, and/or how much unrecorded tape remians on a given side of a videocassette, after a certain amount of recording has already taken place. Many VCRs are equipped with a tape-spool revolution counter which provides the operator with some information about tape position. However, these counters have been of limited use heretofore, since the machine-indicated tape-spool revolution values often do not reflect true tape spool revolution values, and actual tape-playing time may not be linearly related to the tape revolution values. It is known, for example, that the ratio of machine-indicated tape-spool revolution value/actual tape spool revolution value can vary from about 0.9 to 4.0 in VCRs currently in use. As a result, even where a revolution counter is available, operators of VCRs frequently are in doubt as to how much actual available recording time remains on a partially recorded videocassette or how long a program already recorded actually is. Lack of this information can result in waste of valuable videotape, as the operator will frequently use a new videocassette when he might have had space on one of the partially recorded tapes already in his possession. Thus, a device which could compute the available recording time remaining on a videocassette would be useful.

In addition, many operators, in indexing their videocassettes, prefer to show the length, in time, of a recorded program. Unless the time was noted at the time the recording was made, a tape would have to be "run through" at normal playing speed to verify it's actual length in time. Thus, a device which could compute the length in time of already recorded subject matter would also be of use.

Further, because of the wide variablility in machine tape-revolution counters, tape-revolution indexing data which applies to one machine may be of little use if the same tape is used with another machine, such as where a user exchanges a tape with another VCR user. As indicated above, the variation in machine-indicated tape-spool revolution value may be as much as fourfold among different VCR machines, and there is currently no industry standard which governs the relationship between digital counter readings and elapsed time or tape travel. Thus, a device which could enable the operator, after a calibration procedure, to cross index a borrowed videocassette to his particular machine would be useful.

3. SUMMARY OF THE INVENTION

It is therefore one object of the invention to provide a tape-time calculator capable of performing the desirable tape computations referred to above.

Another object of the invention is to provide a device which can be quickly calibrated and is otherwise adapted to function accurately with a variety of video recorders having different index counter ratios, and more generally, to any tape machine which utilizes standard reel or cassette tape as a means of recording or playing video, audio, or digital programmed matter.

It is yet another object of the invention to provide such a device which is inexpensive in manufacture and simple in operation.

The tape-time calculator of the present invention is designed for use in correlating actual tape-play times or tape length with tape spool revolution values provided by an index counter, e.g., a tape-spool revolution counter, in a tape machine. The calculator, or apparatus, includes a first member having a logarithmic scale representing machine-indicated tape-spool revolution values, and a playing-time scale representing actual tape playing times. A second member in the apparatus is attached to the first member, for shifting with respect thereto, and carries a time-scale indicator to indicate a selected time on the playing-time scale, according to the relative positions of the two members. The second member also carries a ratio marker which is positioned on the second member such that alignment of the marker with a selected tape-spool revolution value on the first member positions the indicator to indicate on said playing-time scale, the actual playing time corresponding to that tape-spool revolution value.

The two members are preferably planar disks which are relatively rotatable about a common central axis, where the first member has a larger diameter than the second member, the tape-revolution and playing-time scales are carried on portions of the first member lying beyond and the within the area of overlap of said two members, respectively, and the second member includes means defining a window which allows for viewing of the time scale in the region of the time-scale indicator. More than one time scale may be included, to permit calculation of tape-playing times at different machine speeds.

The ratio marker is preferably a selected indicia on a logarithmic scale carried on the second member, this scale representing different ratios of machine-indicated tape-spool revolution value/actual tape revolution value which are found on different tape machines. The particular indicia (scale position) which is selected for use may be marked by an adhesive-backed pointer or the like, during initial machine calibration, to permanently establish this ratio.

These and other objects and features of the invention will become more fully apparent when the following detailed description of the invention is read in conjunction with the accompanying drawings.

DETAILED DESCRIPTION OF THE INVENTION

Figure 1:
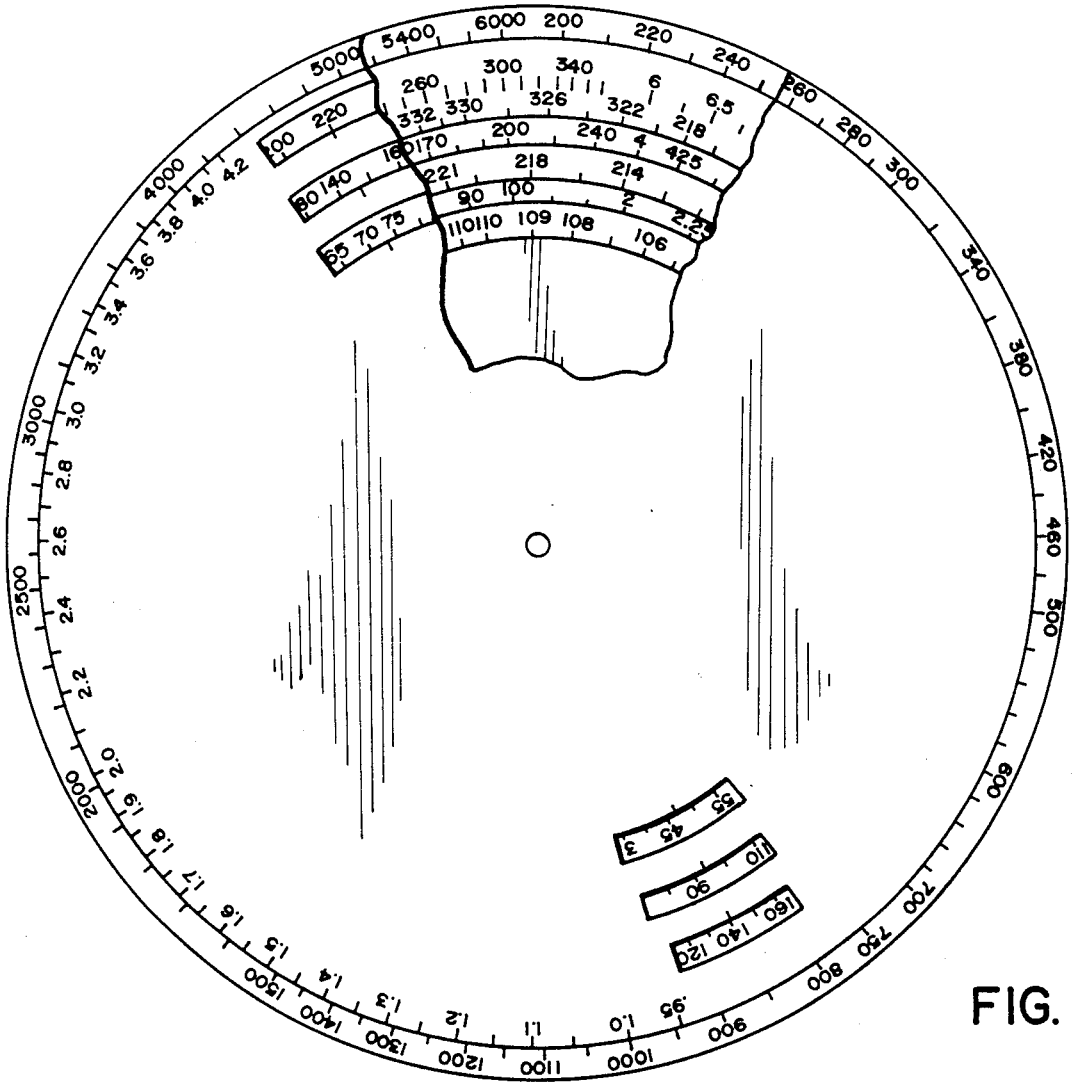
FIG. 1 illustrates a circular calculator constructed according to the invention.
Figure 2:
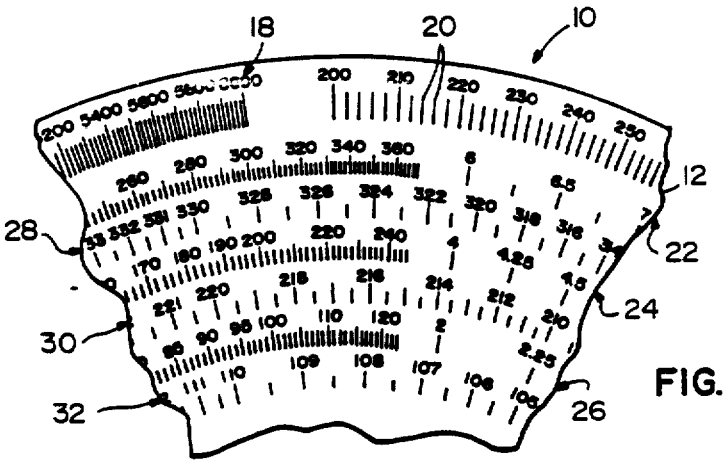
Figure 1:
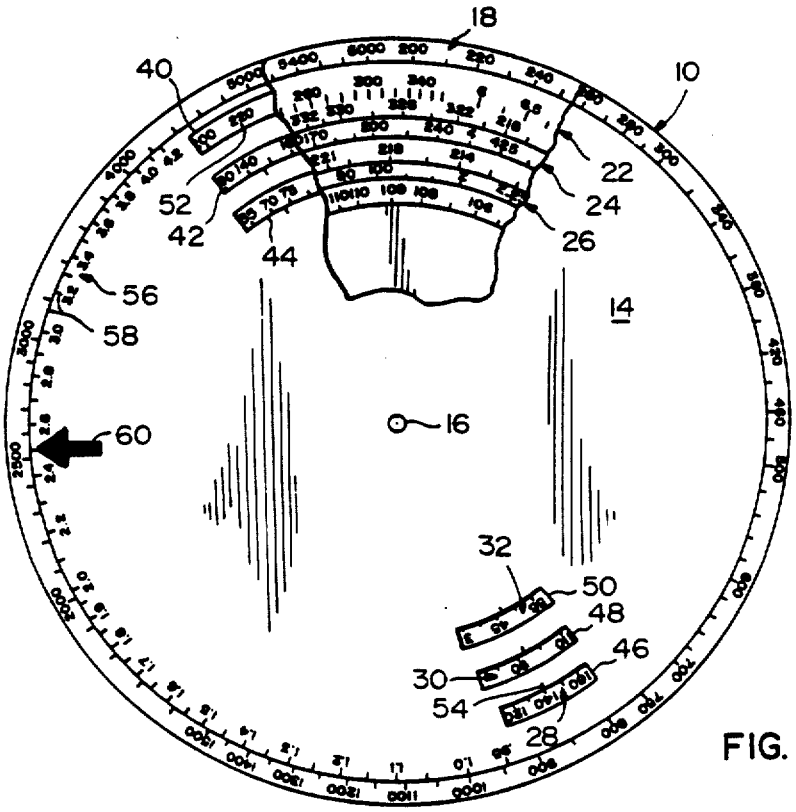

FIG. 1 shows a calculator, or apparatus, 10 constructed according to the invention. The calculator includes a lower plate plate 12, and an upper plate 14 which is attached to the base plate by a rivet 16 for rotation about the common centers of the two plates. The lower and upper plates are also referred to herein as first and second members, respectively.

Figure 2:
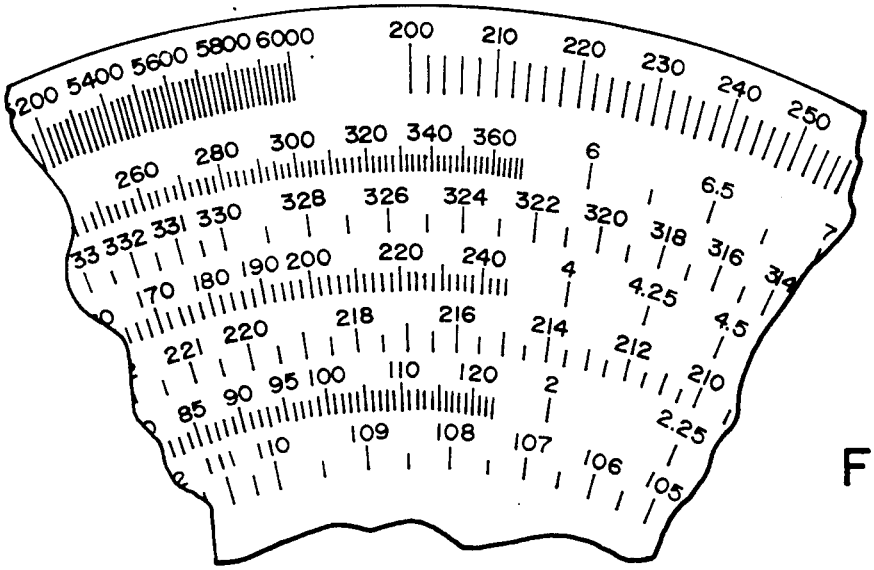
FIG. 2 shows an enlarged view of the upper cutaway portion of the calculator seen in FIG. 1.

The lower plate contains a logarithmic tape-revolution scale 18 whose indicia, such as indicia 20 seen in both figures, represent tape-revolution values, or numbers, which correspond to those obtained from an index counter in a conventional tape-playing machine. In the particular embodiment shown, the tape-revolution numbers range from 200 up to 6,000, and the scale covers all but about 10° or less of the outer circumference of the plate, adjacent the plate's perimeter. As seen in the enlarged portion of the scale shown in FIG. 2, the scale indicia are in 2-revolution increments at the lower end of the scale, and at 20-revolution increments at the upper end of the scale.

The portion of scale 18 between 200 and about 1420 is sufficient to cover the actual accumulated revolutions of a take-up spool of a standard T-120 videocassette. However, for reasons which will be seen below, the actual tape-spool revolution value from some commerical machines may be as high as 6,000 near the end of a standard T-120 cassette. Thus, the scale is designed to cover the range of index revolution counts (omitting portions of the tape below readings of 200 revolution) which can be expected from different VCRs using the conventional T-120 cassettes. It will be understood that scale 18 can easily be adapted for other cassette formats or tape-machine applications, by suitable adjustment in the scale range.

Also carried on the base plate are six playing-time scales which are designated at 22, 24, 26, and 28, 30, 32 in the figures. As can be seen from this figure, the playing time values on scales 22, 24, and 26 are multiples of one another, representing total cassette playing time values of about six, four, and two hours, respectively. These three scales will be described with reference to scale 22, it being understood that the other two scales are smaller-radius scales whose radially aligned indicia represent time values, in minutes, which are either two-thirds (scale 24) or one-third (scale 26) of the values in scale 22. The time values on scales 28, 30, and 32 are similarly multiples of each other, also spanning total play times of about six, four, and two hours, respectively. These scales will be described below with reference to scale 28.

The playing time values in scale 22 relate actual playing times to spool revolutions, according to the known mathematical relationship between time of play and (a) number of spool revolutions, (b) tape thickness, (c) spool radius, and (d) tape speed. The exemplary apparatus described and illustrated herein has a scale designed to related actual playing times to spool revolutions in a machine having an index counter governed by revolutions of the take-up spool. Similar time/spool-revolution relations can be derived for use in constructing a scale which is applicable to a machine having an index counter governed by revolutions of a supply spool. The apparatus, as it would be used with a machine with a supply-spool index counter, might be conveniently constructed on the back side of the apparatus illustrated.

Alternatively, the relationship between playing time and spool revolution (in a machine whose index counter is governed by revolutions of either a take-up or supply spool) can be determined empirically, by plotting actual play time as a function of machine-indicated tape-revolution value, for a given tape-playing machine. Once the playing-time values, as a function of tape revolution are determined, the scale is adjusted by a suitable normalizing factor so that the final tape-playing time (e.g., 360 minutes) corresponds to the 6,000 revolution value in scale 18. For example, if the playing time values were determined on the basis of six hours for 1,420 tape revolutions, then the time values would all be multiplied by about 4.22 to "normalize" scale 22 to scale 18. As will be seen below, this normalizing factor is the ratio $R_m$ of machine-indicated tape-spool revolution value/actual tape spool revolution value.

Scale 22 can be arranged on the base plate so that each playing-time point on the scale is radially aligned with the corresponding tape-revolution value in scale 18, assuming an $R_m$ value of about 4.225, i.e., where the 6000 spool revolution value represents maximum play time, such as b 6 hours. Alternatively, the two scales can be angularly offset by any number of degrees, as shown in the figures, where the two scales are offset, in corresponding values, by 10–20 degrees.

It can be appreciated from the above that the angular scale distances between each pair of values in scale 22 is the same as that for the corresponding tape-spool revolution values in scale 18. That is, for any two time points $t_1$ and $t_2$ on scale 22 which correspond to calculated spool revolution values of $v_1$ and $v_2$, respectively, on scale 18, the distance $t_1$–$t_2$ in radians on scale 22 is the same as the distance $v_1$–$v_2$ in radians on scale 18. More generally, the scale distance (linear or radial) between each pair of points on the playing-time scale is the same as that for the corresponding tape-spool revolution values on the tape-spool revolution scale, where the two scales may be arrayed linearly or circularly.

It can also be appreciated that although the playing-time scale is directly related to the logarithmic tape-revolution scale, scale 22 is not itself a strictly logarithmic scale. This is because the relationship between take-up spool revolutions and playing time is not a linear function, but rather one in which actual playing time per revolution increases as the total number of revolution varies depending on the outermost radius of the counter-governing tape spool at a given time.

Scales 24 and 26 have the same properties, with respect to scale 18, as does scale 22, and only differ from scale 22 by time multiplication factors, as mentioned above. Although scales 24, and 26 are illustrated in the figures in radial alignment with corresponding multiple values in scale 22, the two scales may each have a separate angular offset with respect to scale 22, as well as with respect to scale 18.

Scale 28 is the complement of scale 22, in that the playing-time values on scale 28 indicate in minutes the amount of tape-playing time remaining on a six hour tape, at any given number of tape revolutions (rather than the time elapsed, as in scale 22). The time values for scale 28 are therefore calculated, for each corresponding tape revolution value, by subtracting the value determined for scale 22 from 360 minutes. Thus, for each tape-revolution value, the sum of the corresponding playing time elapsed values (scale 22), and playing time remaining (scale 28) is equal to the total tape-playing time, in the present case, 360 minutes.

Scales 30, and 32 are similarly calculated from scales 24, 26, respectively, by subtracting the values on those scales from 240 or 120 minutes, respectively. Since the larger time values in scales 28, 30, 32 correspond to the smaller time values in scales 22, 24, 26, respectively, and vice versa, the larger values in scales 28, 30, 32, become more widely spaced, as can be appreciated from FIG. 2. Like scales 22, 24, 26, the corresponding scales 28, 30, 32, respectively may have any arbitrary angular offset with respect to scale 18. In the present invention, the three scales are mutually aligned, but angularly offset from corresponding scales 22, 24, and 26, and also from scale 18.

Plate 14, which will now be described with reference to FIG. 1, is rotatably mounted on plate 12, as indicated above, for substantially unhindered rotation with respect thereto about an axis through the center points of the two plates. The diameter of the upper plate is slightly less than that of the base plate, such that the upper plate covers the six playing-time scales, but not the outer tape-revolution scale, on the lower plate. The diameter of plate 12 is preferably between about 15–25 cm, and that of the upper plate, about 1 cm less.

Formed in the upper plate are six arcuate windows, designated 40, 42, 44, 46, 48, 50, in FIG. 1. Windows 40, 42, and 44 on one side of the plate are radially positioned for viewing portions of scales 22, 24, 26, respectively, and windows 46, 48, and 50 on the other side of the plate are radially positioned for viewing portions of scales 28, 30, and 32, respectively. That is, the time values viewed through windows 40, 42, and 44 are elapsed playing times, at total tape-play times of 6, 4, and 2 hours, and the time values viewed through windows 46, 48, 50 are playing times remaining on 6, 4, and 2 hour tapes, respectively. At the center region of each window is a time-scale indicator, such as indicator 52 associated with window 40, and indicator 54 associated with window 50. As seen, the indicators are positioned to mate with the indicia in corresponding playing-time scales on plate 12, for purposes of indicating calculated playing-time values on the corresponding scale. The time-scale indicators (and associated windows) are thus positioned so that the sum of the time-elapsed and time remaining read by the indicators, for each of the three different total-play times, is equal to the total play time for that set of scales. Since each of scales 22, 24, 26 and 28, 30, 32 are angularly aligned, so are the time-scale indicators associated with the scales. If the scales in each group are not angularly aligned, the corresponding time-scale indicators are positioned so that each of the three scales in a group is read simultaneously at the same relative position on each scale. For example, if 3 hours is read on scale 22, 2, and 1 hours would be read on scales 24, 26, respectively, at the same position of the upper plate.

The upper plate also has a logarithmic scale 56, whose indicia, such as indicia 58, represent the possible $R_m$ values for different VCRs which are available commercially. The indicia, or selected indicia, are also referred to herein as $R_m$ or ratio markers. Tests conducted in support of the present invention indicate that $R_m$ values range from about 0.9 to as high as about 4 in different makes of machines which have been tested.

In the embodiment shown, scale 56, which ranges from about 0.9 to 4.2, is laid out on the perimeter of upper plate 14, such that ratio values of 1 and 4.225 can be aligned simultaneously with the tape-revolution values of 1420 and 6,000, respectively, in scale 18. Thus, where the index counter in a machine having an $R_m$ of 1 would indicate 1420 (the end of a standard T-120 cassette), the index counter in a machine having an $R_m$ value of 4.225 would indicate a reading of about 6,000 at the end of the same cassette. It can be appreciated from this that the ratio scale has the effect of converting machine-indicated tape spool revolution values to actual tape-spool revolution value, by "dividing" the machine-indicated value by the ratio value on scale 56. For example, if it is assumed that the machine ratio is 3.0, the actual tape revolution value can be determined by setting the scale indicium for $R_m=3$ to to the machine-indicated tape-spool revolution value (e.g., 3,000) in scale 18 and reading the tape spool revolution value corresponding to a ratio of 1 (e.g., 1,000 revolutions).

The angular positioning of scale 56 is determined by the angular position of any one of the time-scale indicators whose angular positions, as noted above, are internally consistent with respect to the six playing time scales on plate 12. Specifically, the positioning of scale 56 is such that, when the ratio indicium for the ratio value of 1 on scale 56 is set at any selected tape-revolution value on scale 18, the selected time-scale indicator indicates the actual elapsed time (on scales 22, 24, 26) in making that number of actual revolutions, at the selected tape speed (2, 4, or 6 hours total play time). For example, since it requires about 220 minutes to play 1,000 revolutions of a tape whose total length is about 1,420 revolutions, at a total play time of 360 minutes, the position of the ratio 1 indicium will correspond to about 1,000 revolutions on scale 18, when indicator 52 is set at 220 minutes on scale 22, as illustrated in FIG. 1.

In the most general case, the logarithmic $R_m$ scale can be replaced by a single $R_m$ ratio marker 60 which is positioned by the user at a selected position on the periphery of plate 14, as part of a machine calibration procedure which will be described below. As will be seen, the procedure determines the $R_m$ value for a given machine, and the marker is placed on the upper plate at the position corresponding to the same-ratio indicium on scale 56. Preferably, the calcaultor includes both ratio scale and a separate marker which can be positioned by the user at the ratio position determined.

In operation, the calculator is first calibrated to the tape-playing machine of interest. The object of the calibration step is to determine the ratio of machine-indicated tape revolutions/actual tape revolutions which occur within a selected tape-playing time. In one recommended calibration procedure, the operator runs a fully rewound T-120 cassette for a period of about 30 minutes, and then takes note of the observed digital counter reading and tape speed. The operator then sets the appropriate window (22, 24, or 26) time-scale indicator line at the calibrated time, e.g., 30 minutes, for that particular tape speed and then records the ratio indicium on scale 56 which corresponds to the observed digital counter reading, as indicated on scale 18. Alternatively, or in addition, the position on the upper plate which is aligned with the observed digital counter reading can be marked by the above adhesive-backed marker, to mark the ratio position which will be used for the machine tested. In the latter case, it is not necessary to actually record the ratio obtained, nor does the calculator need a scale of ratio indicia, such as scale 56, since the desired ratio is established intrinsically from the calibration. Of course, the calibration step may be avoided if the required ratio value is available from the machine manufacturer or other sources, such as trade journals. However, the calibration approach is recommended, to compensate for internal errors due to manufacturing and wear.

Describing the basic operation of the calculator, assume, as shown in FIG. 1, that the tape-playing machine of interest has been calibrated to an $R_m$ value of 2.5. This means that the digital counter of the machine will read 2,500 when 1,000 tape revolutions of the take-up spool have occurred. This is seen in FIG. 1, which shows the ratio marker pointing to 2,500, and the unity ratio marker (ratio equal to 1) pointing to 1,000. The actual time elaspsed, which is related to the actual number of spool revolutions, is now determined by reading the time-scale indicator associated with the selected play time. For a total play time of 6 hours, time-scale indicator 52 indicates that about 220 minutes has elapsed. Similarly, time-scale indicator 54 indicates that about 140 minutes remain on the tape.

The following examples illustrate various functions which can be carried out with the calculator.

EXAMPLE 1

Determine available recording time on a tape

With the counter reset to zero at the beginning of the tape, advance, play, or record the tape to point at which knowledge of time remaining is desired. Rotate the upper scale to position the ratio-scale marker at the machine-indicated tape-spool revolution value. As descirbed above, this operation will place the unity $R_m$ value at the actual number of tape revolutions which have occurred. The time remaining on the tape, at any given tape speed is now read from the appropriate time-scale indicator associated with windows 46, 48, 50.

EXAMPLE 2

Determine actual recording time on a tape

This procedure is identical to that described in example 1, except that the elapsed time of playing is read from the the appropriate time-scale indicator associated with windows 40, 42, or 44. If the portion of the tape of interest is between two other recorded programs, the length of the intermediate program can similarly be determined by (a) determining indicated revolution values at the beginning and end of the intermediate program, (b) calculating total tape-playing times corresponding to each recorded value, and (c) subtracting the smaller from the larger elapsed time values.

EXAMPLE 3

Determine tape positions when two different machines are involved

Assume in this example that a given program ends at machine-indicated value X on one machine. It is now desired to determine the digital counter number corresponding to this same position, when a second tape-playing machine is used.

Initially, the time elapsed on the tape at the end of the given program is determined for the first machine, using the procedure in Example 2. The second machine is then calibrated, as above, to determine its ratio value on scale 56. With the upper plate set to give the same elapsed playing time (i.e., without moving the upper plate), the machine-recorded revolution value for the second machine is indicated on scale 18, corresponding to the position of the ratio indicium determined for the second machine.

From the foregoing it can be appreciated how various objects and features of the invention are met. The calculator provides a simple, easily operated tool for correlating tape spool revolution values (digital counter values) provided by tape playing machines with actual play times related to those values. The calculator can be adjusted to accommodate tape-playing machines having a wide variation in digital counter ratios, and may be used for keeping track of elapsed or remaining playing times when two or more different machine are involved.

Although the calculator has been described with respect to one preferred embodiment, it will be appreciated that various modifications and changes can be made without departing from the invention. In particular, the calculator may be constructed as a linear, rather than circular, device, where two relatively slidable linear members replace the upper and lower plates of calculator 10, and the second of the two linear members contains means, such as a clear plastic attachment, for reading playing time values on the first member, when a ratio marker on the second member is positioned adjacent a tape-revolution value on the first member. Further, as indicated, the calculator can be adapted for a variety of tape-playing machines, other than VCRs of the type described.

Additionally, the time scale could be replaced with any other scale that represents actual play time in a tape spool. For example, the time scales could be abstract program locations, indicated by letters A–N which represent the actual play times of each of a series of segments A–N contained on the tape. Thus, for example, if a tape having identified segments A–N were identified by the tape manufacturer as containing timed segments A–N, one could calculate, or locate, from the machine-indicated spool revolution values, and knowing the $R_m$ value for the tape machine being used, the actual program segment on the tape.

It is claimed:

1. Apparatus for use in correlating actual tape play time, tape length, or predetermined tape program locations with tape-spool revolution values provided by a tape-revolution index counter in a tape machine, comprising:

(a) a first member having a logarithmic tape-revolution scale representing machine-indicated tape spool revolution values, and a playing-time scale representing actual tape playing times, where the relative scale distance between each pair of values on the playing-time is the same as that for the corresponding pair of tape-spool revolution values on the tape-revolution scale, (b) a second member attached to the first member, for shifting with respect thereto, (c) a time-scale indicator carried on said second member to indicate a selected time on said playing-time scale, according to the relative positions of the two members, and (d) a ratio marker which is positioned on the second member such that alignment of the marker with a selected tape-spool revolution value on the first marker positions the indicator to indicate on said playing-time scale, the actual playing time corresponding to that tape revolution value.

2. The apparatus of claim 1, wherein said two members include planar disks which are relatively rotatable about a common central axis.

3. The apparatus of claim 2, wherein the first member has a larger diameter than the second member, said tape-revolution and playing-time scales are carried on portions of the first member lying beyond and the within the area of overlap of said two members, respectively, and said second member includes means defining a window which allows for viewing of the time scale in the region of said time-scale indicator.

4. The apparatus of claim 1, wherein the said ratio marker is a selected indicia on a logarithmic scale carried on the second member, and representing different ratios of machine-indicated tape-spool revolution value-/actual tape-spool revolution values, which are found on different tape machines.

5. The apparatus of claim 1, wherein said ratio marker can be attached at a selected position on said second member.

6. The apparatus of claim 1, which further includes a time-remaining scale carried on first member, and representing actual time-remaining values, a second time indicator carried on the second member to indicate a selected time on said time-remaining scale, and positioned with respect to the first-mentioned time indicator such that the sum of the times indicated by the two time indicators is substantially equal to the total play time of a selected-length tape being played on such machine at a selected speed.

7. The apparatus of claim 1, wherein said first member further includes, in addition to the first-mentioned time scale, second and third time scales which are each fractionally related to the first-mentioned scale, and said second member includes a time indicator for each time scale.

* * * * *

UNITED STATES PATENT AND TRADEMARK OFFICE

CERTIFICATE OF CORRECTION

PATENT NO. : 4,754,125

DATED : June 28, 1988

INVENTOR(S) : Roy A. Penn

It is certified that error appears in the above-identified patent and that said Letters Patent is hereby corrected as shown below:

The title page showing the illustrative figure should be deleted and replaced with the title page as shown on the attached page. The sheet of drawing consisting of Figs. 1 and 2 should be deleted to be replaced with the sheet of drawing consisting of Figs. 1 and 2 as shown on the attached sheet.

Signed and Sealed this

Twenty-ninth Day of January, 1991

*Attest:*

HARRY F. MANBECK, JR.

*Attesting Officer*

*Commissioner of Patents and Trademarks*

United States Patent [19]

Penn

[11] Patent Number: 4,754,125

[45] Date of Patent: Jun. 28, 1988

[54] TIME-TAPE CALCULATOR

[76] Inventor: Roy A. Penn, 406 N. Citrus Ave., Los Angeles, Calif. 90036

[21] Appl. No.: 935,811

[22] Filed: Nov. 28, 1986

[51] Int. Cl.[4] ..... G06C 3/00

[52] U.S. Cl. ..... 235/88 R; 235/78 R

[58] Field of Search ..... 235/103, 78 R, 88 R, 235/119

[56] References Cited

U.S. PATENT DOCUMENTS

| | | | |
|---|---|---|---|
| 3,157,354 | 11/1964 | Henry | 235/119 |
| 3,747,846 | 7/1973 | Long | 235/78 X |
| 4,456,821 | 6/1984 | Harten | 235/78 R |

*Primary Examiner*—Benjamin R. Fuller

*Attorney, Agent, or Firm*—Ciotti & Murashige, Irella & Manella

[57] ABSTRACT

Apparatus for use in correlating actual tape play times, tape length, or predetermined tape program locations with tape-spool revolution values provided by a tape-revolution index counter in a tape machine. The calculator has a lower circular base plate and a smaller, upper circular plate which rotates concentrically with respect to the lower plate. The base plate carries a scale corresponding to tape-spool revolution values indicated by the machine, and one or more time scales relating tape spool revolution values to actual tape-play times, and/or to remaining play times or program locations. A ratio marker and time scale indicator are positioned on the upper member such that alignment of the ratio marker with a selected tape-revolution value on the base plate brings the time scale indicator into alignment with the corresponding playing-time value on the base plate.

7 Claims, 1 Drawing Sheet

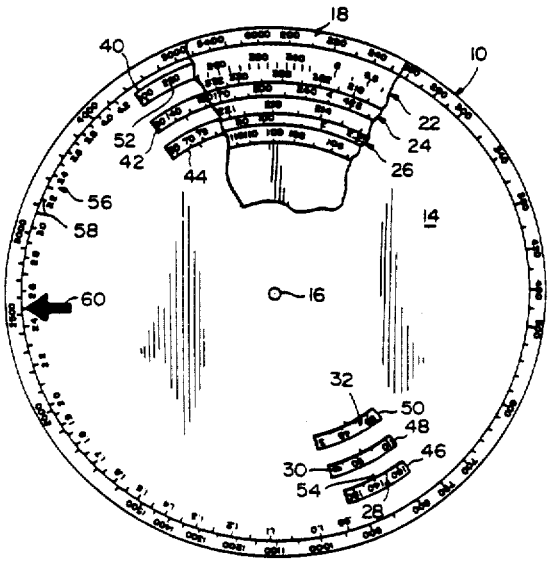

U.S. Patent Jun. 28, 1988 4,754,125